US005662252A

United States Patent [19]

Martin

[11] Patent Number: 5,662,252

[45] Date of Patent: Sep. 2, 1997

[54] TORSO STRAP FOR HOLDING TUBULAR BODIES

[76] Inventor: Sammy Lee Martin, 10805 Thunderhead Dr., Colorado Springs, Colo. 80925

[21] Appl. No.: 618,996

[22] Filed: Mar. 21, 1996

[51] Int. Cl.[6] ..... A45F 3/14

[52] U.S. Cl. ..... 224/250; 224/660; 224/901.4; 224/909

[58] Field of Search ..... 224/150, 606, 224/610, 620, 627, 660, 250, 257, 258, 901, 901.4, 901.6, 901.2, 908, 909, 917

[56] References Cited

U.S. PATENT DOCUMENTS

| | | | |
|---|---|---|---|
| 2,830,747 | 4/1958 | Creste | 224/150 |
| 2,990,089 | 6/1961 | Nystrom | 224/257 |
| 3,319,852 | 5/1967 | Perkins | 224/150 |
| 3,326,430 | 6/1967 | Banks | 224/908 |
| 3,326,431 | 6/1967 | Belleni | 224/257 |
| 3,526,347 | 9/1970 | Kuban | 224/909 |
| 3,960,302 | 6/1976 | Mazzoni, Jr. | 224/901.4 |
| 4,337,938 | 7/1982 | Rodriguez | 224/901.4 |
| 4,898,311 | 2/1990 | Boyer | 224/257 |
| 4,984,724 | 1/1991 | Johnston | 224/901.4 |
| 5,009,346 | 4/1991 | Butler | 224/150 |
| 5,016,797 | 5/1991 | Rowledge | 224/257 |
| 5,044,538 | 9/1991 | Bader | 224/250 |
| 5,246,154 | 9/1993 | Adams et al. | 224/250 |

OTHER PUBLICATIONS

Journal of The American Medical Association; vol. 168, No. 7, p. 930 Oct. 1958.

*Primary Examiner*—Henry J. Recla
*Assistant Examiner*—Gregory M. Vidovich
*Attorney, Agent, or Firm*—Patent & Trademark Services; Joseph H. McGlynn

[57] ABSTRACT

A stabilizing device for articles such as binoculars or cameras suspended from a user's neck by a neck strap including an elastic strap being adapted to fit snugly about a user's torso and having a pair of ends, each of the ends having a spaced apart pair of mating hook and loop fasteners and being adapted to form a loop about a tubular portion of the suspended article such that in use the suspended article is secured to the user's torso and is movable to a position adjacent the user's eyes for viewing therethrough by stretching the elastic strap. The article stabilizing device further includes a sleeve of material substantially covering said elastic strap to protect it.

5 Claims, 1 Drawing Sheet

TORSO STRAP FOR HOLDING TUBULAR BODIES

BACKGROUND OF THE INVENTION

This invention relates, in general, to a device for stabilizing an article worn about a user's neck and in particular, to a stabilizing device for a suspended pair of binoculars, cameras or the like.

The present invention is especially useful for bird watchers, nature lovers, soldiers and hunters who trek through the woods and over rough terrain carrying multiple pieces of equipment. An article suspended only by a neck strap will swing and bounce as the user moves along causing noise, discomfort and possible damage to the article. The present invention solves these problems in a convenient and cost effective manner.

DESCRIPTION OF THE PRIOR ART

In the prior art various types of stabilizing devices are known. For example, U.S. Pat. No. 4,898,311 discloses a device for keeping binoculars secured to the user's body. The device includes a length of surgical tubing with each end of the surgical tubing having a plug piece therein. Each plug piece has a hole for connection to one of a pair of metal rings. One metal ring is connected directly to the binoculars and the other metal ring is connected via a quick release coupling to the binoculars.

U.S. Pat. No. 3,326,431 discloses a fastener for binoculars or the like including an upwardly opening hook as part of a retainer member and a cooperating lanyard member. The retainer member is attached to the user's clothing while the lanyard member is attached to the binoculars. In use, the lanyard member is hooked onto the retainer member to stabilize the suspended binoculars. The fastener is released by simply lifting the binoculars to the user's eyes thus freeing the lanyard member from the hook of the retainer member.

U.S. Pat. No. 2,990,089 discloses a body support for binoculars comprising a support plate carried by a body embracing harness and arranged to detachably support a bracket assembly fixed to the binoculars. The support plate includes a pair of headed studs which detachably connect to a pair of slots in the bracket assembly.

U.S. Pat. No. 5,016,797 discloses an article carrier including a pair of identical shoulder straps which extend from approximately the center of the chest of a user, over the shoulders, cross in the back and pass under the arms of the user to the chest area and a pair of swivel hooks slidable on the shoulder straps. With this carrier, an article such as binoculars can be slid smoothly from the carrying position to the in use position with out disconnecting the article from the carrier.

While various types of stabilizing straps are known in the prior art, they all suffer from disadvantages. The largest disadvantage is, the article they are used with must have a securing means already attached in order to fasten the stabilizing straps to. For example, the 2,990,089 device uses a specially designed plate that must be secured to the binoculars. The 3,326,431 and 5,016,797 devices utilize hooks that are permanently attached to the binoculars to attach a stabilizing chain or strap. In the 4,898,311 device special connectors must be attached to the ends of the stabilizing strap to secure it to the binoculars.

If the device to be carried does not have hooks or some other form of attachment means already on the device, it will require a special type of fastener to attach the strap. This requires extra expense which translates into a higher price for the strap. What is needed is a fastening means for the strap that is inexpensive and can be fastened directly to the article to be carried so no special attachment means is needed.

SUMMARY OF THE INVENTION

The present invention is directed to a device for stabilizing an article which is suspended by a neck strap about the user's neck. This is accomplished by securing the article to the user's torso via an elastic strap with looped ends. The device includes an elastic strap with ends having spaced apart hook and loop fasteners for connecting directly to the suspended article. The device optionally includes a sleeve of camouflage material or some other type of design which substantially covers the entire elastic strap to make it more appealing and to protect the strap.

It is an object of the present invention to provide a device which stabilizes an article suspended by a neck strap by securing the article to the user's torso.

It is an object of the present invention to provide a device which protects a suspended article and keeps the article in a convenient location near the user's chest.

It is an object of the present invention to provide a device which stretches to allow normal viewing through a suspended article and contracts to move the suspended article to a convenient stored location.

It is an object of the present invention to provide a device which attaches directly to the suspended article and requires no special attachment means.

These and other objects and advantages of the present invention will be fully apparent from the following description, when taken in connection with the annexed drawings.

DESCRIPTION OF THE PREFERRED EMBODIMENT

Figure 1:
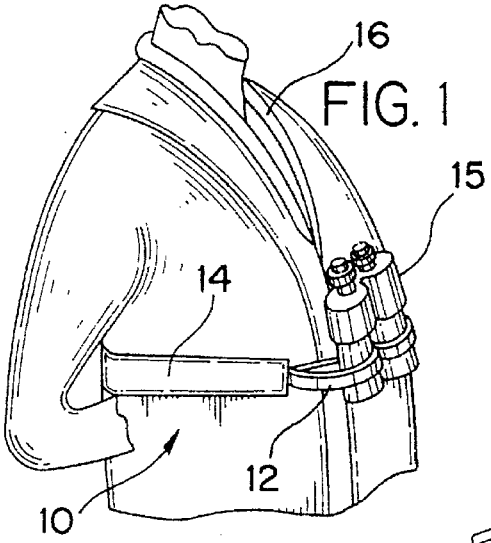
FIG. 1 is a perspective view of the present invention shown in use.
Figure 2:
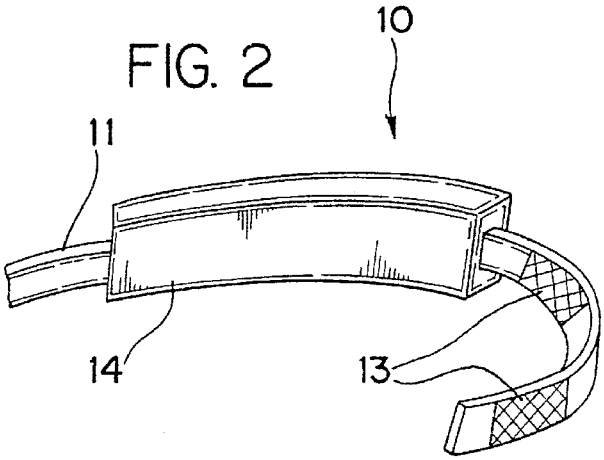
FIG. 2 is a partial perspective view of the present invention.
Figure 3:
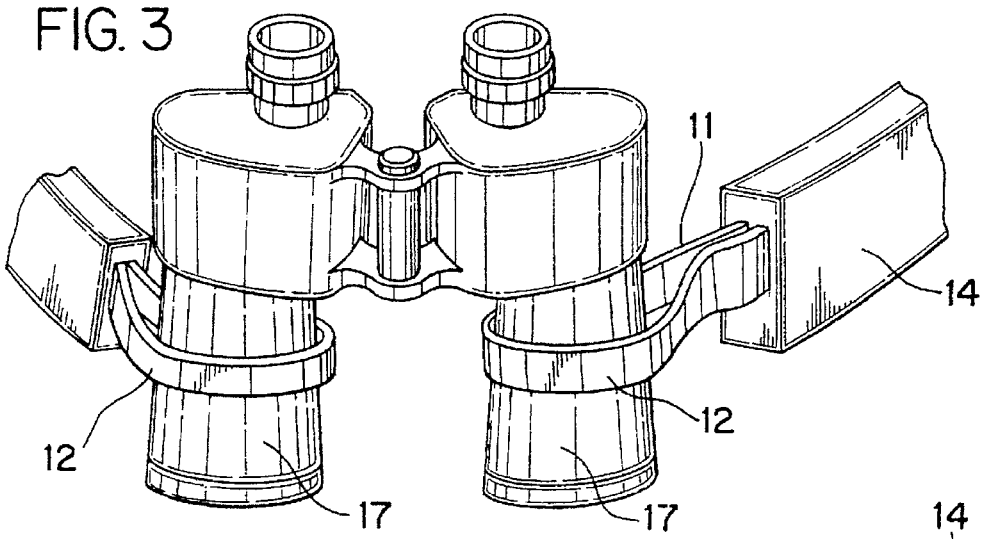
FIG. 3 is a partial frontal view of the present invention with the ends connected to a pair of binoculars.

Referring now to the drawings in greater detail, FIG. 1 shows the stabilizing device 10 in use. The device is designed to stabilize an article, such as a pair of binoculars 15 which are suspended about a person's neck by a conventional carrying strap 16. In FIG. 2 and FIG. 3 the device includes an elastic strap 11, which can be made from rubber or some other stretchable material, and which is long enough to encircle a person's torso. The elastic material that the strap is made from will stretch to accommodate most people. Also, for people of unusually large or small size, straps of different lengths could be used.

Figure 4:
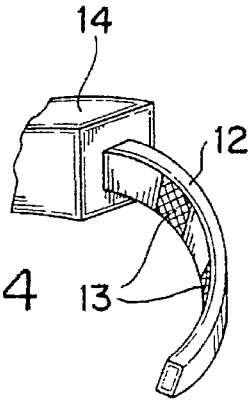
FIG. 4 is another embodiment showing a different placement for the hook and loop fasteners.

The elastic strap 11 has a pair of ends 12, 12, one end of which is shown in FIG. 2, and a second embodiment is shown in FIG. 4. The strap is adapted to fit snugly about a user's torso, as shown in FIG. 1. Each of the ends 12 has a spaced apart pair of mating hook and loop fasteners 13, 13.

Each end is adapted to form a loop about a tubular portion 17 of the suspended article 15, as shown in FIGS. 1 and 3, such that in use the suspended article is resiliently secured to the user's torso and will not bounce around as the user moves. This is especially important for someone who is moving through rough country such as a forest, where the article could hit against a tree or rock and be damaged.

In the embodiment shown in FIG. 2, one of the hook and loop fasteners is attached to the inside (the part closest to the user's body) and the other half of the hook and loop fastener is attached to the outside of the strap. In order to attach the strap 11 to the binoculars 15, the strap ends are wrapped around the circular part 17 of the binoculars until the hook and loop fasteners meet and secure the binoculars.

In the embodiment shown in FIG. 4, both of the hook and loop fasteners are attached to the inside (the part closest to the user's body) of the strap. In order to attach the strap 11 to the binoculars 15, the strap ends are wrapped around the circular part 17 of the binoculars until the hook and loop fasteners meet and secure the binoculars. The different positions of the fasteners will make the stabilizing strap more versatile and will enable it to be attached to items with different sizes.

When it is necessary to use the binoculars, the user merely has to raise them to eye level, which can be accomplished easily due to the elastic nature of the strap 11. The suspended article can be easily movable to a position adjacent the user's eyes for viewing by stretching the elastic strap 11 and when the user is finished using the binoculars, the strap will help pull them back to the stored position.

The article stabilizing device 10 can further include a decorative sleeve made from, for example, but not limited to, a camouflage material 14. The sleeve will substantially cover the entire elastic strap 11, and in addition to increasing the esthetics of the strap will also help to protect the strap from snags or dirt. The sleeve could be made from vinyl or nylon and is preferably manufactured using an electronically heat welded vinyl process. Vinyl or nylon may be die cut and heat welded together. The "die cutting" of the sheet vinyl is a process which cuts vinyl into a specific shape through the use of steel ruled dies. Steel ruled dies are flat, sharpened pieces of steel which resemble a hacksaw blade. The dies are bent into the desired shape and held in place by channels cut out into a thick sheet of wood. In operation, the sharpened edges of the die are brought into face to face contact with a flat piece of vinyl. The die is pressed against the vinyl sheet, cutting it to the shape of the sleeve 14. Nylon cloth could also be used for the material of the sleeve, which would be cut and sewn into the shape of the sleeve and attached by the same method as the vinyl. Of course other materials and methods could be used to make and attach the sleeve 14 to the strap 11 without departing from the scope of the present invention.

Although the stabilizing device and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An article stabilizing device for articles suspended from a user's neck by a neck strap in combination with an article, comprising:

said article having a pair of tubular bodies adapted for viewing there through, each body having a length and a circumference, said article having no external means for attachment of said article stabilizing device, said article stabilizing device comprising:

an elastic strap having a pair of ends, said strap being adapted to fit snugly about a user's torso, each of said ends having a spaced apart pair of mating fasteners, and each of said ends respectively extending completely around the circumference of said bodies, and each of said ends being secured with said mating fasteners, whereby in use the suspended article is firmly secured to the user's torso by said elastic strap, and is movable to a position adjacent the user's eyes for viewing there through by stretching the elastic strap.

2. The article stabilizing device as claimed in claim 1, wherein said mating fasteners are hook and loop fasteners.

3. The article stabilizing device as claimed in claim 1, wherein said device further comprises a sleeve of material substantially covering said elastic strap.

4. The article stabilizing device as claimed in claim 1, wherein said mating fasteners are both attached to the same side of said elastic strap.

5. The article stabilizing device as claimed in claim 1, wherein said mating fasteners are attached to different sides of said elastic strap.

* * * * *